US007876341B2

(12) United States Patent
Credelle et al.

(10) Patent No.: US 7,876,341 B2
(45) Date of Patent: Jan. 25, 2011

(54) SUBPIXEL LAYOUTS FOR HIGH BRIGHTNESS DISPLAYS AND SYSTEMS

(75) Inventors: Thomas Lloyd Credelle, Morgan Hill, CA (US); Candice Hellen Brown Elliott, Santa Rosa, CA (US); Anthony Botzas, San Jose, CA (US)

(73) Assignee: Samsung Electronics Co., Ltd. (KR)

( * ) Notice: Subject to any disclaimer, the term of this patent is extended or adjusted under 35 U.S.C. 154(b) by 968 days.

(21) Appl. No.: 11/684,499

(22) Filed: Mar. 9, 2007

(65) Prior Publication Data

US 2008/0049047 A1 Feb. 28, 2008

Related U.S. Application Data

(63) Continuation-in-part of application No. 11/467,916, filed on Aug. 28, 2006.

(51) Int. Cl.
*G09G 5/10* (2006.01)

(52) U.S. Cl. ..... 345/695; 345/690

(58) Field of Classification Search ..... 345/76, 345/82, 690, 695
See application file for complete search history.

(56) References Cited

U.S. PATENT DOCUMENTS

| | | | |
|---|---|---|---|
| 3,971,065 | A | 7/1976 | Bayer |
| 4,632,514 | A | 12/1986 | Ogawa et al. |
| 4,642,619 | A | 2/1987 | Togashi |
| 4,751,535 | A | 6/1988 | Myers |
| 4,786,964 | A | 11/1988 | Plummer et al. |
| 4,800,375 | A | 1/1989 | Silverstein et al. |
| 4,853,592 | A | 8/1989 | Strathman |
| 4,886,343 | A | 12/1989 | Johnson |
| 4,965,565 | A | 10/1990 | Noguchi |
| 5,006,840 | A | 4/1991 | Hamada et al. |
| 5,052,785 | A | 10/1991 | Takimoto et al. |
| 5,113,274 | A | 5/1992 | Takahashi et al. |
| 5,132,674 | A | 7/1992 | Bottorf |
| 5,196,924 | A | 3/1993 | Lumelsky et al. |
| 5,233,385 | A | 8/1993 | Sampsell |
| 5,311,205 | A | 5/1994 | Hamada et al. |
| 5,311,337 | A | 5/1994 | McCartney, Jr. |
| 5,315,418 | A | 5/1994 | Sprague et al. |
| 5,334,996 | A | 8/1994 | Tanigaki et al. |
| 5,341,153 | A | 8/1994 | Benzschawel et al. |
| 5,398,066 | A | 3/1995 | Martinez-Uriegas et al. |

(Continued)

FOREIGN PATENT DOCUMENTS

| | | | |
|---|---|---|---|
| CN | 1800934 | A | 7/2006 |

(Continued)

OTHER PUBLICATIONS

Adobe Systems, Inc. website, http://www.adobe.com/products/acrobat/cooltype.html.

(Continued)

*Primary Examiner*—Quan-Zhen Wang
*Assistant Examiner*—Tony Davis
(74) *Attorney, Agent, or Firm*—Innovation Counsel LLP

(57) ABSTRACT

A display device comprises a display panel comprising high brightness subpixel repeating groups—for example, RGBW display panels. Displays comprise subpixel repeating groups that in some embodiments are part-striped colored subpixels and part-checkerboard pattern colored subpixels.

13 Claims, 8 Drawing Sheets

U.S. PATENT DOCUMENTS 5,416,890 A 5/1995 Beretta
5,450,216 A 9/1995 Kasson
5,461,503 A 10/1995 Deffontaines et al.
5,485,293 A 1/1996 Robinder
5,541,653 A 7/1996 Peters et al.
5,563,621 A 10/1996 Silsby
5,724,442 A 3/1998 Ogatsu et al.
5,731,818 A 3/1998 Wan et al.
5,815,101 A 9/1998 Fonte
5,818,405 A 10/1998 Eglit et al.
5,821,913 A 10/1998 Mamiya
5,917,556 A 6/1999 Katayama
5,929,843 A 7/1999 Tanioka
5,933,253 A 8/1999 Ito et al.
5,949,496 A 9/1999 Kim
5,991,438 A 11/1999 Shaked et al.
6,008,868 A 12/1999 Silverbrook
6,023,315 A 2/2000 Harrold et al.
6,023,527 A 2/2000 Narahara
6,034,666 A 3/2000 Kanai et al.
6,049,626 A 4/2000 Kim
6,064,424 A 5/2000 Van Berkel
6,072,445 A 6/2000 Spitzer et al.
6,088,050 A 7/2000 Ng
6,097,367 A 8/2000 Kuriwaki et al.
6,108,053 A 8/2000 Pettitt et al.
6,108,122 A 8/2000 Ulrich et al.
6,137,560 A 10/2000 Utsumi et al.
6,144,352 A 11/2000 Matsuda et al.
6,188,385 B1 2/2001 Hill et al.
6,219,025 B1 4/2001 Hill et al.
6,225,973 B1 5/2001 Hill et al.
6,236,390 B1 5/2001 Hitchcock
6,239,783 B1 5/2001 Hill et al.
6,243,055 B1 6/2001 Fergason
6,243,070 B1 6/2001 Hill et al.
6,256,425 B1 7/2001 Kunzman
6,262,710 B1 7/2001 Smith
6,278,434 B1 8/2001 Hill et al.
6,297,826 B1 10/2001 Semba et al.
6,326,981 B1 12/2001 Mori et al.
6,327,008 B1 12/2001 Fujiyoshi
6,332,030 B1 12/2001 Manjunath et al.
6,348,929 B1 2/2002 Acharya et al.
6,360,008 B1 3/2002 Suzuki et al.
6,360,023 B1 3/2002 Betrisey et al.
6,377,262 B1 4/2002 Hitchcock et al.
6,384,836 B1 5/2002 Naylor, Jr. et al.
6,385,466 B1 5/2002 Hirai et al.
6,392,717 B1 5/2002 Kunzman
6,393,145 B2 5/2002 Betrisey et al.
6,396,505 B1 5/2002 Lui et al.
6,441,867 B1 8/2002 Daly
6,453,067 B1 9/2002 Morgan et al.
6,459,419 B1 10/2002 Matsubayashi
6,466,618 B1 10/2002 Messing et al.
6,469,766 B2 10/2002 Waterman et al.
6,483,518 B1 11/2002 Perry et al.
6,486,923 B1 11/2002 Maeshima et al.
6,570,584 B1 5/2003 Cok et al.
6,577,291 B2 6/2003 Hill et al.
6,583,787 B1 6/2003 Pfister et al.
6,590,996 B1 7/2003 Reed et al.
6,593,981 B1 7/2003 Haim et al.
6,600,495 B1 7/2003 Boland et al.
6,614,414 B2 9/2003 De Haan et al.
6,624,828 B1 9/2003 Dresevic et al.
6,633,302 B1 10/2003 Ohsawa et al.
6,661,429 B1 12/2003 Phan
6,674,430 B1 1/2004 Kaufman et al.
6,674,436 B1 1/2004 Dresevic et al.
6,681,053 B1 1/2004 Zhu
6,714,243 B1 3/2004 Mathur et al.
6,724,934 B1 4/2004 Lee et al.
6,738,526 B1 5/2004 Betrisey et al.
6,750,874 B1 6/2004 Kim
6,750,875 B1 6/2004 Keely, Jr. et al.
6,771,028 B1 8/2004 Winters
6,781,626 B1 8/2004 Wang
6,801,220 B2 10/2004 Greier et al.
6,804,407 B2 10/2004 Weldy
6,833,890 B2 12/2004 Hong et al.
6,842,207 B2 1/2005 Nishida et al.
6,850,294 B2 2/2005 Roh et al.
6,856,704 B1 2/2005 Gallagher et al.
6,867,549 B2 3/2005 Cok et al.
6,870,523 B1 3/2005 Ben-David et al.
6,885,380 B1 4/2005 Primerano et al.
6,888,604 B2 5/2005 Rho et al.
6,897,876 B2 5/2005 Murdoch et al.
6,903,378 B2 6/2005 Cok
6,930,676 B2 8/2005 De Haan et al.
6,937,217 B2 8/2005 Klompenhouwer et al.
6,950,156 B1 9/2005 Yoshida
6,989,876 B2 1/2006 Song et al.
7,027,105 B2 4/2006 Lee et al.
7,110,012 B2 9/2006 Messing et al.
7,123,277 B2 10/2006 Brown Elliott et al.
7,184,066 B2 2/2007 Elliot et al.
7,184,067 B2 2/2007 Miller et al.
7,221,381 B2 * 5/2007 Brown Elliott et al. ..... 345/690
7,636,076 B2 12/2009 Hung et al.
2001/0048764 A1 12/2001 Betrisey et al.
2002/0030780 A1 3/2002 Nishida et al.
2002/0054263 A1 5/2002 Kim et al.
2002/0093476 A1 7/2002 Hill et al.
2002/0140831 A1 10/2002 Hayashi
2002/0191130 A1 12/2002 Liang et al.
2003/0011613 A1 1/2003 Booth, Jr.
2003/0034992 A1 2/2003 Brown Elliott et al.
2003/0071775 A1 4/2003 Ohashi et al.
2003/0085906 A1 5/2003 Elliott et al.
2003/0103058 A1 6/2003 Elliott et al.
2003/0117457 A1 6/2003 Qiao
2003/0128179 A1 7/2003 Credelle
2003/0128225 A1 7/2003 Credelle et al.
2003/0128872 A1 7/2003 Lee et al.
2003/0146893 A1 8/2003 Sawabe
2003/0151694 A1 8/2003 Lee et al.
2003/0218618 A1 11/2003 Phan
2004/0008208 A1 1/2004 Dresevic et al.
2004/0021804 A1 2/2004 Hong et al.
2004/0036704 A1 2/2004 Han et al.
2004/0046725 A1 3/2004 Lee
2004/0051724 A1 3/2004 Elliott et al.
2004/0061710 A1 4/2004 Messing et al.
2004/0085495 A1 5/2004 Roh et al.
2004/0094766 A1 5/2004 Lee et al.
2004/0095521 A1 5/2004 Song et al.
2004/0113875 A1 * 6/2004 Miller et al. ..... 345/82
2004/0114046 A1 6/2004 Lee et al.
2004/0140983 A1 * 7/2004 Credelle ..... 345/613
2004/0150651 A1 8/2004 Phan
2004/0169807 A1 9/2004 Rho et al.
2004/0174375 A1 * 9/2004 Credelle et al. ..... 345/589
2004/0174389 A1 9/2004 Ben-David et al.
2004/0179160 A1 9/2004 Rhee et al.
2004/0189662 A1 9/2004 Frisken et al.
2004/0189664 A1 9/2004 Frisken et al.
2004/0196297 A1 10/2004 Elliott et al.
2004/0222999 A1 11/2004 Choi et al.
2004/0223005 A1 11/2004 Lee
2004/0239813 A1 12/2004 Klompenhouwer
2004/0239837 A1 12/2004 Hong et al.

| | | | | |
|---|---|---|---|---|
| 2004/0263528 | A1 | 12/2004 | Murdoch et al. | |
| 2005/0031199 | A1 | 2/2005 | Ben-Chorin et al. | |
| 2005/0068477 | A1 | 3/2005 | Shin et al. | |
| 2005/0083341 | A1 | 4/2005 | Higgins et al. | |
| 2005/0083344 | A1 | 4/2005 | Higgins | |
| 2005/0083345 | A1 | 4/2005 | Higgins | |
| 2005/0083352 | A1 | 4/2005 | Higgins | |
| 2005/0083356 | A1 | 4/2005 | Roh et al. | |
| 2005/0088385 | A1 | 4/2005 | Elliott et al. | |
| 2005/0094871 | A1 | 5/2005 | Berns et al. | |
| 2005/0099540 | A1 | 5/2005 | Elliott et al. | |
| 2005/0151752 | A1 | 7/2005 | Phan | |
| 2005/0162600 | A1* | 7/2005 | Rho et al. | 349/139 |
| 2005/0169551 | A1 | 8/2005 | Messing et al. | |
| 2005/0190967 | A1 | 9/2005 | Ok et al. | |
| 2005/0212728 | A1 | 9/2005 | Miller et al. | |
| 2005/0219274 | A1 | 10/2005 | Yang et al. | |
| 2005/0225548 | A1 | 10/2005 | Han et al. | |
| 2005/0225561 | A1 | 10/2005 | Higgins et al. | |
| 2005/0225562 | A1 | 10/2005 | Higgins et al. | |
| 2005/0225563 | A1* | 10/2005 | Brown Elliott et al. | 345/604 |
| 2005/0225574 | A1 | 10/2005 | Brown Elliott et al. | |
| 2005/0225575 | A1* | 10/2005 | Brown Elliott et al. | 345/694 |
| 2005/0231534 | A1 | 10/2005 | Lee | |
| 2008/0049048 | A1 | 2/2008 | Credelle et al. | |

FOREIGN PATENT DOCUMENTS

| | | | |
|---|---|---|---|
| DE | 197 46 329 | A1 | 3/1999 |
| DE | 299 09 537 | U1 | 10/1999 |
| DE | 199 23 527 | | 11/2000 |
| EP | 0 322 106 | A2 | 6/1989 |
| EP | 0 793 214 | A1 | 2/1996 |
| EP | 0 899 604 | A2 | 3/1999 |
| JP | 62 127716 | | 6/1987 |
| JP | 02-000826 | A | 1/1990 |
| JP | 11-014978 | | 1/1999 |
| JP | 2004-004822 | | 1/2004 |
| KR | 2003-0086399 | | 11/2003 |
| WO | WO 00/21067 | | 4/2000 |
| WO | WO 00/42564 | | 7/2000 |
| WO | WO 00/42762 | | 7/2000 |
| WO | WO 00/67196 | | 11/2000 |
| WO | WO 00/70392 | | 11/2000 |
| WO | WO 01/29817 | A1 | 4/2001 |
| WO | WO 01/37251 | A1 | 5/2001 |
| WO | WO 02/11112 | A2 | 2/2002 |
| WO | WO 03/056383 | A1 | 7/2003 |
| WO | WO 2004/021323 | A2 | 3/2004 |
| WO | WO 2004/027503 | A1 | 4/2004 |
| WO | WO 2004/086128 | A1 | 10/2004 |
| WO | WO 2005/050296 | A1 | 6/2005 |
| WO | WO 2005/057532 | A2 | 6/2005 |
| WO | WO 2005/065027 | A2 | 7/2005 |
| WO | WO 2005/076257 | A2 | 8/2005 |

OTHER PUBLICATIONS

Betrisey, C., et al., Displaced Filtering for Patterned Displays, SID Symp. Digest 1999, pp. 296-299.

Brown Elliott, C., "Active Matrix Display . . . ", IDMC 2000, 185-189, Aug. 2000.

Brown Elliott, C., "Color Subpixel Rendering Projectors and Flat Panel Displays," SMPTE, Feb. 27-Mar. 1, 2003, Seattle, WA pp. 1-4.

Brown Elliott, C, "Co-Optimization of Color AMLCD Subpixel Architecture and Rendering Algorithms," SID 2002 Proceedings Paper, May 30, 2002 pp. 172-175.

Brown Elliott, C, "Development of the PenTile Matrix™ Color AMLCD Subpixel Architecture and Rendering Algorithms", SID 2003, Journal Article.

Brown Elliott, C, "New Pixel Layout for PenTile Matrix™ Architecture", IDMC 2002, pp. 115-117.

Brown Elliott, C, "Reducing Pixel Count Without Reducing Image Quality", Information Display Dec. 1999, vol. 1, pp. 22-25.

"ClearType magnified", Wired Magazine, Nov. 8, 1999, Microsoft Typography, article posted Nov. 8, 1999, last updated Jan. 27, 1999 1 page.

Credelle, Thomas, "P-00: MTF of High-Resolution PenTile Matrix Displays", Eurodisplay 02 Digest, 2002 pp. 1-4.

Daly, Scott, "Analysis of Subtriad Addressing Algorithms by Visual System Models",SID Symp. Digest, Jun. 2001 pp. 1200-1203.

E-Reader Devices and Software, Jan. 1, 2001, Syllabus, http://www.campus-technology.com/article.asp?id=419.

Feigenblatt, R.I., Full-color imaging on amplitude-quantized color mosaic displays, SPIE, 1989, pp. 199-204.

Feigenblatt, Ron, "Remarks on Microsoft ClearType™", http://www.geocities.com/SiliconValley/Ridge/6664/ClearType.html, Dec. 5, 1998, Dec. 7, 1998, Dec. 12, 1999, Dec. 26, 1999, Dec. 30, 1999 and Jun. 19, 2000, 30 pages.

Gibson, S., "Sub-Pixel Rendering; How it works," Gibson Research Corp., http://www.grc.com/ctwhat.html.

Klompenhouwer, Michiel, Subpixel Image Scaling for Color Matrix Displays, SID Symp. Digest, May 2002, pp. 176-179.

Michiel A. Klompenhouwer, Gerard de Haan, Subpixel image scaling for color matrix displays, Journal of the Society for Information Display, vol. 11, Issue 1, Mar. 2003, pp. 99-108.

Krantz, John et al., Color Matrix Display Image Quality: The Effects of Luminance . . . SID 90 Digest, pp. 29-32.

Lee, Baek-woon et al., 40.5L: Late-News Paper: TFT-LCD with RGBW Color system, SID 03 Digest, 2003, pp. 1212-1215.

Martin, R., et al., "Detectability of Reduced Blue-Pixel Count in Projection Displays," SID Symp. Digest, May 1993, pp. 606-609.

Messing, Dean et al., Improved Display Resolution of Subsampled Colour Images Using Subpixel Addressing, IEEE ICIP 2002, vol. 1, pp. 625-628.

Messing, Dean et al., Subpixel Rendering on Non-Striped Colour Matrix Displays, 2003 International Conf on Image Processing, Sep. 2003, Barcelona, Spain, 4 pages.

"Microsoft ClearType," website, Mar. 26, 2003, 4 pages.

Murch, M., "Visual Perception Basics," SID Seminar, 1987, Tektronix Inc, Beaverton Oregon.

Platt, John, Optimal Filtering for Patterned Displays, IEEE Signal Processing Letters, 2000, 4 pages.

PCT International Search Report dated Jun. 3, 2002 for PCT/US02/12610 (U.S. Appl. No. 10/051,612).

PCT International Search Report dated Sep. 30, 2003 for PCT/US02/24994 (U.S. Appl. No. 10/215,843).

PCT International Search Report dated Jun. 14, 2004 for PCT/US03/028222 (U.S. Appl. No. 10/243,094).

PCT International Search Report dated Jul. 11, 2005 for PCT/US05/010022 (U.S. Appl. No. 10/821,388).

PCT International Search Report dated Jul. 29, 2008 for PCT/US08/56241 (U.S. Appl. No. 11/684,499).

PCT International Search Report dated Aug. 21, 2008 for PCT/US08/59916 (U.S. Appl. No. 11/734,275).

Wendell, Brian A., Stanford University, "Fundamentals of Vision: Behavior . . . ," Jun. 12, 1994, Society for Information Display (SID) Short Course S-2, Fairmont Hotel, San Jose, California.

Werner, Ken, "OLEDS, OLEDS, Everywhere . . . ," Information Display, Sep. 2002, pp. 12-15.

European Search Report and Written Opinion for corresponding EP 2132588 dated Jul. 20, 2010 (8 pages).

* cited by examiner

SUBPIXEL LAYOUTS FOR HIGH BRIGHTNESS DISPLAYS AND SYSTEMS

This application is a continuation in part of U.S. patent application Ser. No. 11/467,916 filed on Aug. 28, 2006, and claims the benefit of priority thereof and which is hereby incorporated by reference in its entirety.

BACKGROUND

Novel sub-pixel arrangements are disclosed for improving the cost/performance curves for image display devices in the following commonly owned United States patents and patent applications including: (1) U.S. Pat. No. 6,903,754 ("the '754 patent") entitled "ARRANGEMENT OF COLOR PIXELS FOR FULL COLOR IMAGING DEVICES WITH SIMPLIFIED ADDRESSING;" (2) United States Patent Publication No. 2003/0128225 ("the '225 application") having application Ser. No. 10/278,353 and entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE," filed Oct. 22, 2002; (3) United States Patent Publication No. 2003/0128179 ("the '179 application") having application Ser. No. 10/278,352 and entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUB-PIXELS," filed Oct. 22, 2002; (4) United States Patent Publication No. 2004/0051724 ("the '724 application") having application Ser. No. 10/243,094 and entitled "IMPROVED FOUR COLOR ARRANGEMENTS AND EMITTERS FOR SUB-PIXEL RENDERING," filed Sep. 13, 2002; (5) United States Patent Publication No. 2003/0117423 ("the '423 application") having application Ser. No. 10/278,328 and entitled "IMPROVEMENTS TO COLOR FLAT PANEL DISPLAY SUB-PIXEL ARRANGEMENTS AND LAYOUTS WITH REDUCED BLUE LUMINANCE WELL VISIBILITY," filed Oct. 22, 2002; (6) United States Patent Publication No. 2003/0090581 ("the '581 application") having application Ser. No. 10/278,393 and entitled "COLOR DISPLAY HAVING HORIZONTAL SUB-PIXEL ARRANGEMENTS AND LAYOUTS," filed Oct. 22, 2002; and (7) United States Patent Publication No. 2004/0080479 ("the '479 application") having application Ser. No. 10/347,001 and entitled "IMPROVED SUB-PIXEL ARRANGEMENTS FOR STRIPED DISPLAYS AND METHODS AND SYSTEMS FOR SUB-PIXEL RENDERING SAME," filed Jan. 16, 2003. Each of the aforementioned '225, '179, '724, '423, '581, and '479 published applications and U.S. Pat. No. 6,903,754 are hereby incorporated by reference herein in its entirety.

For certain subpixel repeating groups having an even number of subpixels in a horizontal direction, systems and techniques to affect improvements, e.g. polarity inversion schemes and other improvements, are disclosed in the following commonly owned United States patent documents: (1) United States Patent Publication No. 2004/0246280 ("the '280 application") having application Ser. No. 10/456,839 and entitled "IMAGE DEGRADATION CORRECTION IN NOVEL LIQUID CRYSTAL DISPLAYS"; (2) United States Patent Publication No. 2004/0246213 ("the '213 application") (U.S. patent application Ser. No. 10/455,925) entitled "DISPLAY PANEL HAVING CROSSOVER CONNECTIONS EFFECTING DOT INVERSION"; (3) United States Patent Publication No. 2004/0246381 ("the '381 application") having application Ser. No. 10/455,931 and entitled "SYSTEM AND METHOD OF PERFORMING DOT INVERSION WITH STANDARD DRIVERS AND BACKPLANE ON NOVEL DISPLAY PANEL LAYOUTS"; (4) United States Patent Publication No. 2004/0246278 ("the '278 application") having application Ser. No. 10/455,927 and entitled "SYSTEM AND METHOD FOR COMPENSATING FOR VISUAL EFFECTS UPON PANELS HAVING FIXED PATTERN NOISE WITH REDUCED QUANTIZATION ERROR"; (5) United States Patent Publication No. 2004/0246279 ("the '279 application") having application Ser. No. 10/456,806 entitled "DOT INVERSION ON NOVEL DISPLAY PANEL LAYOUTS WITH EXTRA DRIVERS"; (6) United States Patent Publication No. 2004/0246404 ("the '404 application") having application Ser. No. 10/456,838 and entitled "LIQUID CRYSTAL DISPLAY BACKPLANE LAYOUTS AND ADDRESSING FOR NON-STANDARD SUBPIXEL ARRANGEMENTS"; (7) United States Patent Publication No. 2005/0083277 ("the '277 application") having application Ser. No. 10/696,236 entitled "IMAGE DEGRADATION CORRECTION IN NOVEL LIQUID CRYSTAL DISPLAYS WITH SPLIT BLUE SUBPIXELS", filed Oct. 28, 2003; and (8) United States Patent Publication No. 2005/0212741 ("the '741 application") having application Ser. No. 10/807,604 and entitled "IMPROVED TRANSISTOR BACKPLANES FOR LIQUID CRYSTAL DISPLAYS COMPRISING DIFFERENT SIZED SUBPIXELS", filed Mar. 23, 2004. Each of the aforementioned '280, '213, '381, '278, '404, '277 and '741 published applications are hereby incorporated by reference herein in its entirety.

These improvements are particularly pronounced when coupled with sub-pixel rendering (SPR) systems and methods further disclosed in the above-referenced U.S. Patent documents and in commonly owned United States Patents and Patent Applications: (1) United States Patent Publication No. 2003/0034992 ("the '992 application") having application Ser. No. 10/051,612 and entitled "CONVERSION OF A SUB-PIXEL FORMAT DATA TO ANOTHER SUB-PIXEL DATA FORMAT," filed Jan. 16, 2002; (2) United States Patent Publication No. 2003/0103058 ("the '058 application") having application Ser. No. 10/150,355 entitled "METHODS AND SYSTEMS FOR SUB-PIXEL RENDERING WITH GAMMA ADJUSTMENT," filed May 17, 2002; (3) United States Patent Publication No. 2003/0085906 ("the '906 application") having application Ser. No. 10/215,843 and entitled "METHODS AND SYSTEMS FOR SUB-PIXEL RENDERING WITH ADAPTIVE FILTERING," filed Aug. 8, 2002; (4) United States Publication No. 2004/0196302 ("the '302 application") having application Ser. No. 10/379,767 and entitled "SYSTEMS AND METHODS FOR TEMPORAL SUB-PIXEL RENDERING OF IMAGE DATA" filed Mar. 4, 2003; (5) United States Patent Publication No. 2004/0174380 ("the '380 application") having application Ser. No. 10/379,765 and entitled "SYSTEMS AND METHODS FOR MOTION ADAPTIVE FILTERING," filed Mar. 4, 2003; (6) U.S. Pat. No. 6,917,368 ("the '368 patent") entitled "SUB-PIXEL RENDERING SYSTEM AND METHOD FOR IMPROVED DISPLAY VIEWING ANGLES"; and (7) United States Patent Publication No. 2004/0196297 ("the '297 application") having application Ser. No. 10/409,413 and entitled "IMAGE DATA SET WITH EMBEDDED PRE-SUBPIXEL RENDERED IMAGE" filed Apr. 7, 2003. Each of the aforementioned '992, '058, '906, '302, 380 and '297 applications and the '368 patent are hereby incorporated by reference herein in its entirety.

Improvements in gamut conversion and mapping are disclosed in commonly owned United States Patents and co-pending United States Patent Applications: (1) U.S. Pat. No. 6,980,219 ("the '219 patent") entitled "HUE ANGLE CALCULATION SYSTEM AND METHODS"; (2) United States Patent Publication No. 2005/0083341 ("the '341 application") having application Ser. No. 10/691,377 and entitled "METHOD AND APPARATUS FOR CONVERTING FROM SOURCE COLOR SPACE TO TARGET COLOR SPACE", filed Oct. 21, 2003; (3) United States Patent Publication No. 2005/0083352 ("the '352 application") having application Ser. No. 10/691,396 and entitled "METHOD AND APPARATUS FOR CONVERTING FROM A SOURCE COLOR SPACE TO A TARGET COLOR SPACE", filed Oct. 21, 2003; and (4) United States Patent Publication No. 2005/0083344 ("the '344 application") having application Ser. No. 10/690,716 and entitled "GAMUT CONVERSION SYSTEM AND METHODS" filed Oct. 21, 2003. Each of the aforementioned '341, '352 and '344 applications and the '219 patent is hereby incorporated by reference herein in its entirety.

Additional advantages have been described in (1) United States Patent Publication No. 2005/0099540 ("the '540 application") having application Ser. No. 10/696,235 and entitled "DISPLAY SYSTEM HAVING IMPROVED MULTIPLE MODES FOR DISPLAYING IMAGE DATA FROM MULTIPLE INPUT SOURCE FORMATS", filed Oct. 28, 2003; and in (2) United States Patent Publication No. 2005/0088385 ("the '385 application") having application Ser. No. 10/696,026 and entitled "SYSTEM AND METHOD FOR PERFORMING IMAGE RECONSTRUCTION AND SUBPIXEL RENDERING TO EFFECT SCALING FOR MULTI-MODE DISPLAY" filed Oct. 28, 2003, each of which is hereby incorporated herein by reference in its entirety.

Additionally, each of these co-owned and co-pending applications is herein incorporated by reference in its entirety: (1) United States Patent Publication No. 2005/0225548 ("the '548 application") having application Ser. No. 10/821,387 and entitled "SYSTEM AND METHOD FOR IMPROVING SUB-PIXEL RENDERING OF IMAGE DATA IN NON-STRIPED DISPLAY SYSTEMS"; (2) United States Patent Publication No. 2005/0225561 ("the '561 application") having application Ser. No. 10/821,386 and entitled "SYSTEMS AND METHODS FOR SELECTING A WHITE POINT FOR IMAGE DISPLAYS"; (3) United States Patent Publication No. 2005/0225574 ("the '574 application") and United States Patent Publication No. 2005/0225575 ("the '575 application") having application Ser. Nos. 10/821,353 and 10/961,506 respectively, and both entitled "NOVEL SUBPIXEL LAYOUTS AND ARRANGEMENTS FOR HIGH BRIGHTNESS DISPLAYS"; (4) United States Patent Publication No. 2005/0225562 ("the '562 application") having application Ser. No. 10/821,306 and entitled "SYSTEMS AND METHODS FOR IMPROVED GAMUT MAPPING FROM ONE IMAGE DATA SET TO ANOTHER"; (5) United States Patent Publication No. 2005/0225563 ("the '563 application") having application Ser. No. 10/821,388 and entitled "IMPROVED SUBPIXEL RENDERING FILTERS FOR HIGH BRIGHTNESS SUBPIXEL LAYOUTS"; and (6) United States Patent Publication No. 2005/0276502 ("the '502 application") having application Ser. No. 10/866,447 and entitled "INCREASING GAMMA ACCURACY IN QUANTIZED DISPLAY SYSTEMS."

Additional improvements to, and embodiments of, display systems and methods of operation thereof are described in: (1) Patent Cooperation Treaty (PCT). Application No. PCT/US 06/12768, entitled "EFFICIENT MEMORY STRUCTURE FOR DISPLAY SYSTEM WITH NOVEL SUBPIXEL STRUCTURES" filed Apr. 4, 2006, and published in the United States as United States Patent Application Publication 200Y/AAAAAAA; (2) Patent Cooperation Treaty (PCT) Application No. PCT/US 06/12766, entitled "SYSTEMS AND METHODS FOR IMPLEMENTING LOW-COST GAMUT MAPPING ALGORITHMS" filed Apr. 4, 2006, and published in the United States as United States Patent Application Publication 200Y/BBBBBBB; (3) U.S. patent application Ser. No. 11/278,675, entitled "SYSTEMS AND METHODS FOR IMPLEMENTING IMPROVED GAMUT MAPPING ALGORITHMS" filed Apr. 4, 2006, and published as United States Patent Application Publication 2006/0244686; (4) Patent Cooperation Treaty (PCT) Application No. PCT/US 06/12521, entitled "PRE-SUBPIXEL RENDERED IMAGE PROCESSING IN DISPLAY SYSTEMS" filed Apr. 4, 2006, and published in the United States as United States Patent Application Publication 200Y/DDDDDDD; and (5) Patent Cooperation Treaty (PCT) Application No. PCT/US 06/19657, entitled "MULTIPRIMARY COLOR SUBPIXEL RENDERING WITH METAMERIC FILTERING" filed on May 19, 2006 and published in the United States as United States Patent Application Publication 200Y/EEEEEEE (referred to below as the "Metamer Filtering application".) Each of these co-owned applications is also herein incorporated by reference in their entirety.

BRIEF DESCRIPTION OF THE DRAWINGS

The accompanying drawings are incorporated in, and constitute a part of this specification, and illustrate exemplary implementations and embodiments.

FIGS. 7*a*1 through 7*c*4 are various embodiments of the present application.

DETAILED DESCRIPTION

Reference will now be made in detail to implementations and embodiments, examples of which are illustrated in the accompanying drawings. Wherever possible, the same reference numbers will be used throughout the drawings to refer to the same or like parts.

The description that follows discusses several embodiments of subpixel arrangements or layouts that are suitable for high brightness display panels. These subpixel arrangements depart from the conventional RGB stripe layout, and some of the novel arrangements disclosed in many of the applications incorporated by reference above, in that many of the subpixel arrangements comprise stripes and checkboards of colored subpixels.

Novel Subpixel Repeating Groups Comprising Stripes and Checkerboards

Figure 1:
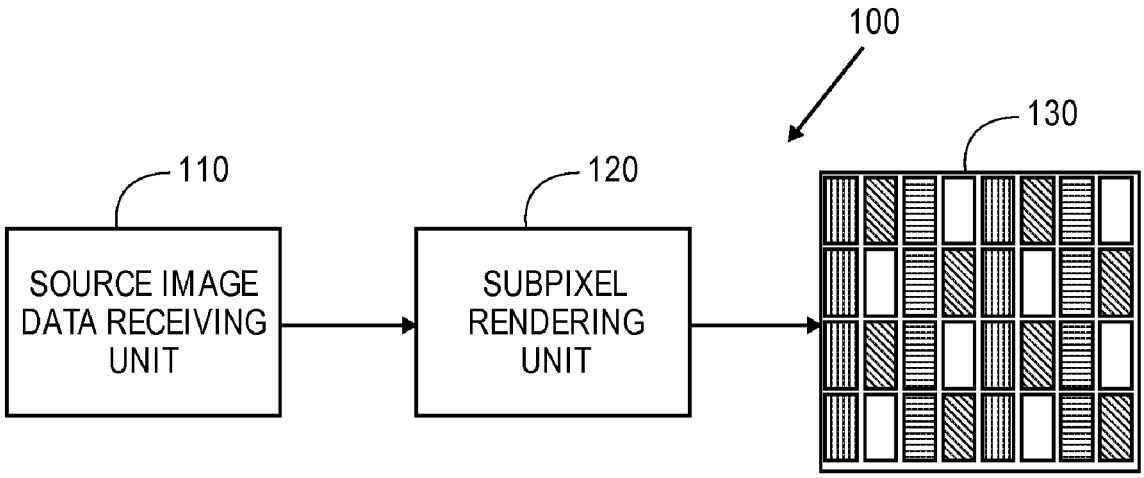
FIG. 1 is one embodiment of a display system comprising a display further comprising one embodiment of a novel subpixel layout.

FIG. 1 is a block diagram of a display device 100 which comprises a display panel 130 which may be manufactured to have any one of the subpixel repeating groups shown in the present application, or any of the variations thereof discussed above. Display device 100 also includes a source image data receiving unit 110 configured to receive source image data that indicates an image to be rendered on display panel 130. Display device 100 also may include a subpixel rendering unit 110 configured to render the image indicated by the source image data onto display panel 130 using the subpixel rendering techniques described in many applications incorporated above.

Figure 2:
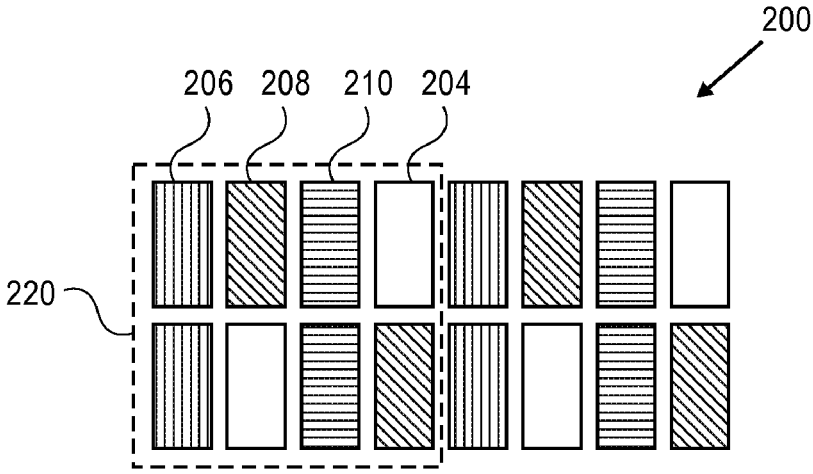
FIGS. 2-4 are embodiments of novel subpixel layouts comprising partial colored subpixel stripes and colored subpixel checkerboard pattern.
Figure 3:
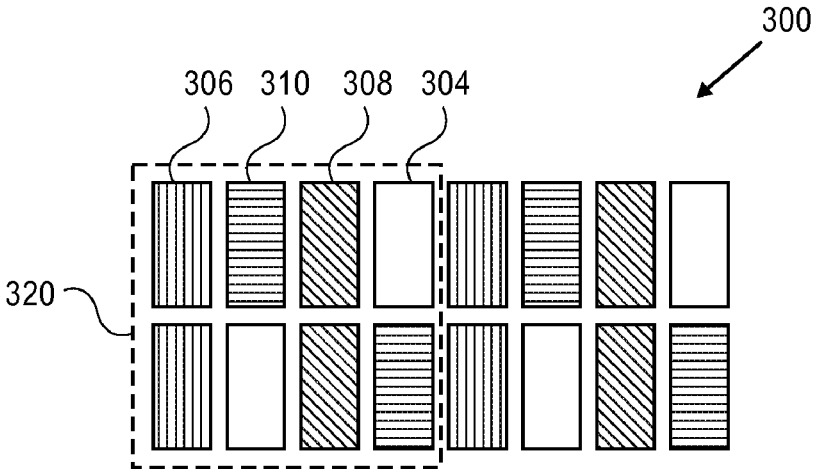
Figure 4:
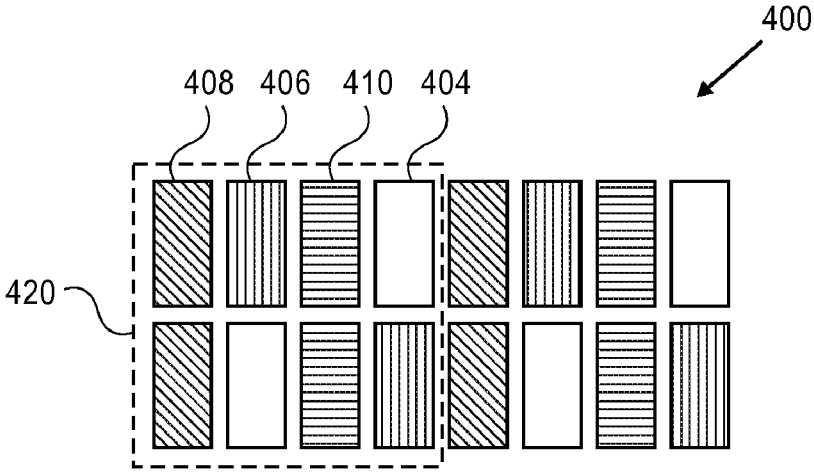

Three embodiments of the subpixel layouts substantially comprising a part striped and part checkerboard repeating pattern are illustrated in FIGS. 2, 3, and 4 and were previously disclosed in the parent application, U.S. patent application Ser. No. 11/467,916. The term "substantially" is used to accommodate various display panel manufacturing constraints; a display panel may be constructed so as not to begin or end with an entire one of the subpixel repeating groups, but still largely comprise the subpixel repeating group.

In general, each of the display panels of FIGS. 2, 3 and 4 comprise a plurality of subpixel repeating groups, each comprising eight subpixels of three primary colors and a fourth color arranged in first and second rows and forming four columns of subpixels. Each of said first and second rows comprises one subpixel in each of the three primary colors and the fourth color. Subpixels in first and second primary colors are disposed in nonadjacent columns to form stripes, while subpixels in the third primary color and in the fourth color are disposed in nonadjacent columns in opposing rows such that each of subpixels in the third primary color and in the fourth color are disposed on a checkerboard pattern. The term "checkerboard" is meant to consider the third and fourth primary colored subpixels without regard to first and second primary colored subpixels. For example in FIG. 2, the white and the blue subpixels form a "checkerboard" pattern—similar to the black and white squares on the familiar checkers game board.

FIG. 2 illustrates a portion 200 of a display panel comprising eight subpixel repeating group 220. In subpixel repeating group 220, the red subpixel 206 (shown with vertical hatching) and the blue subpixel 210 (shown with horizontal hatching) are disposed in vertical stripes, while the green subpixel 208 (shown with diagonal hatching) and the white subpixel 204 (shown with no hatching) are disposed on a checkerboard pattern.

FIG. 3 illustrates a portion 300 of a display panel comprising eight subpixel repeating group 320. In subpixel repeating group 320, the red subpixel 2006 and the green subpixel 308 are disposed in vertical stripes, while the blue subpixel 310 and the white subpixel 304 are disposed on a checkerboard pattern.

FIG. 4 illustrates a portion 400 of a display panel comprising eight subpixel repeating group 420. In subpixel repeating group 420, the green subpixel 408 and the blue subpixel 410 are disposed in vertical stripes, while the red subpixel 406 and the white subpixel 404 are disposed on a checkerboard pattern.

Variations of each of the subpixel repeating groups shown in FIGS. 2-4 are also possible. For example, each of the display panels could be configured with a subpixel repeating group of one of FIGS. 2-4 in which the subpixels have aspect ratios different from that shown in these figures, or in which the subpixels have a substantially square shape, as opposed to the rectangular shape shown in the figures. In another variation, the first and second rows of the subpixel repeating group in each figure could be switched. In such a modified subpixel arrangement, the first row of the subpixel repeating group 1920 of FIG. 19 would be arranged as R (red), W (white) B (blue) and G (green), and the second row of subpixel repeating group 1920 could be arranged as R, G, B and W. In another variation, each of the display panels could be configured with a subpixel repeating group of one of FIGS. 2-4 in which the subpixel repeating group is rotated ninety degrees (90°) to the left or right, or otherwise translated into a different orientation. In another variation, each of the display panels could be configured with a subpixel repeating group of one of FIGS. 2-4 in which the subpixels in the striped columns are made smaller or larger than the subpixels in the columns including the white subpixels, or are offset from adjacent columns. It will be appreciated, then, that many types of mirror images and symmetrical transformations of the subpixel repeating groups shown in FIGS. 2-4 are possible, and are contemplated within the scope of the appended claims. Many of these types of variations, as applied to different subpixel repeating groups, are illustrated in US 2005/0225574 entitled "Novel Subpixel Layouts and Arrangements for High Brightness Displays" which is incorporated by reference herein.

Figure 5:
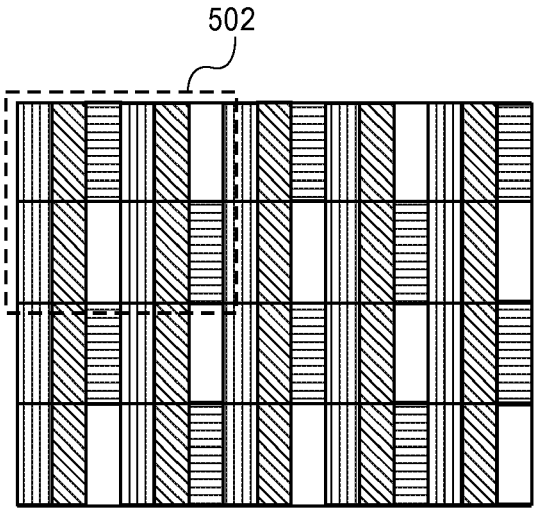
FIG. 5 is another embodiment of a novel subpixel layout comprising partial colored subpixel stripes and colored subpixel checkerboard pattern.

FIG. 5 depicts another embodiment of a novel display. A panel comprising subpixel repeat grouping 502 shows that the red and green subpixels form a stripe in adjacent columns and followed by alternating white and blue subpixels down a next column and alternating blue and white subpixels down another column not adjacent to the first alternating white and blue subpixel column. FIGS. 7*a*2, 7*b*1-*b*2 and 7*c*1-*c*2 are other embodiments of subpixel repeating groups which may substantially comprise a display. FIG. 7*a*1 discloses the same subpixel repeating group as group 502. Of course, the present application encompasses other embodiments in which the colors of the stripes (e.g. red stripe followed by a green stripe) is switched (e.g. green stripe is followed by a red stripe) and the checkerboard pattern is mirror-imaged.

The subpixel arrangements as disclosed herein may be of any aspect ratio imaginable—e.g. 1:1, 1:2, 1:3, 2:3 etc. However, as depicted in the various figures, it may be desirable to construct the subpixels in an aspect ratio of 1:3 which is common for LCD panels. One reason is that the same TFT backplane and/or drive circuitry may be employed for these novel layouts as is currently used for conventional RGB stripe displays.

Additionally, for displays having a dots-per-inch (dpi) of less than a certain dpi (e.g. 250 dpi), these part-stripe, part-checkerboard subpixel arrangements in a 1:3 aspect ratio may improve the performance of black fonts on color backgrounds. In such a case, there would be as many red and green color subpixels as for RGB stripe, and black fonts on colored backgrounds may not appear as serrated. In fact, these novel subpixel arrangements have full resolution in two colors and half resolution in third color and the added white subpixel.

Figure 6:
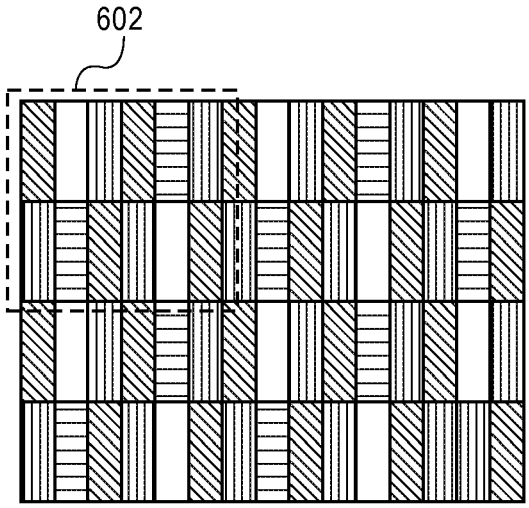
FIG. 6 is one embodiment of a novel subpixel layout in a 1:3 aspect ratio.

FIG. 6 is a display (substantially comprising repeating group 602) that is not of the part-striped, part-checkerboard pattern; but would have the same number of red and green colored subpixels as a comparable RGB stripe display of 1:3 aspect ratio. The display of FIG. 6 would again have full resolution in two colors and half resolution in third color and added white subpixel. The same is seen for the displays of FIGS. 7*a*3-*a*4, 7*b*3-*b*4 and 7*c*3-*c*4 where the fully sampled colors are not always red and green, but can be red and blue or green and blue. Of course, the present application encompasses embodiments in which all symmetries and mirror images of assigned color subpixels may be made.

Figure 7:
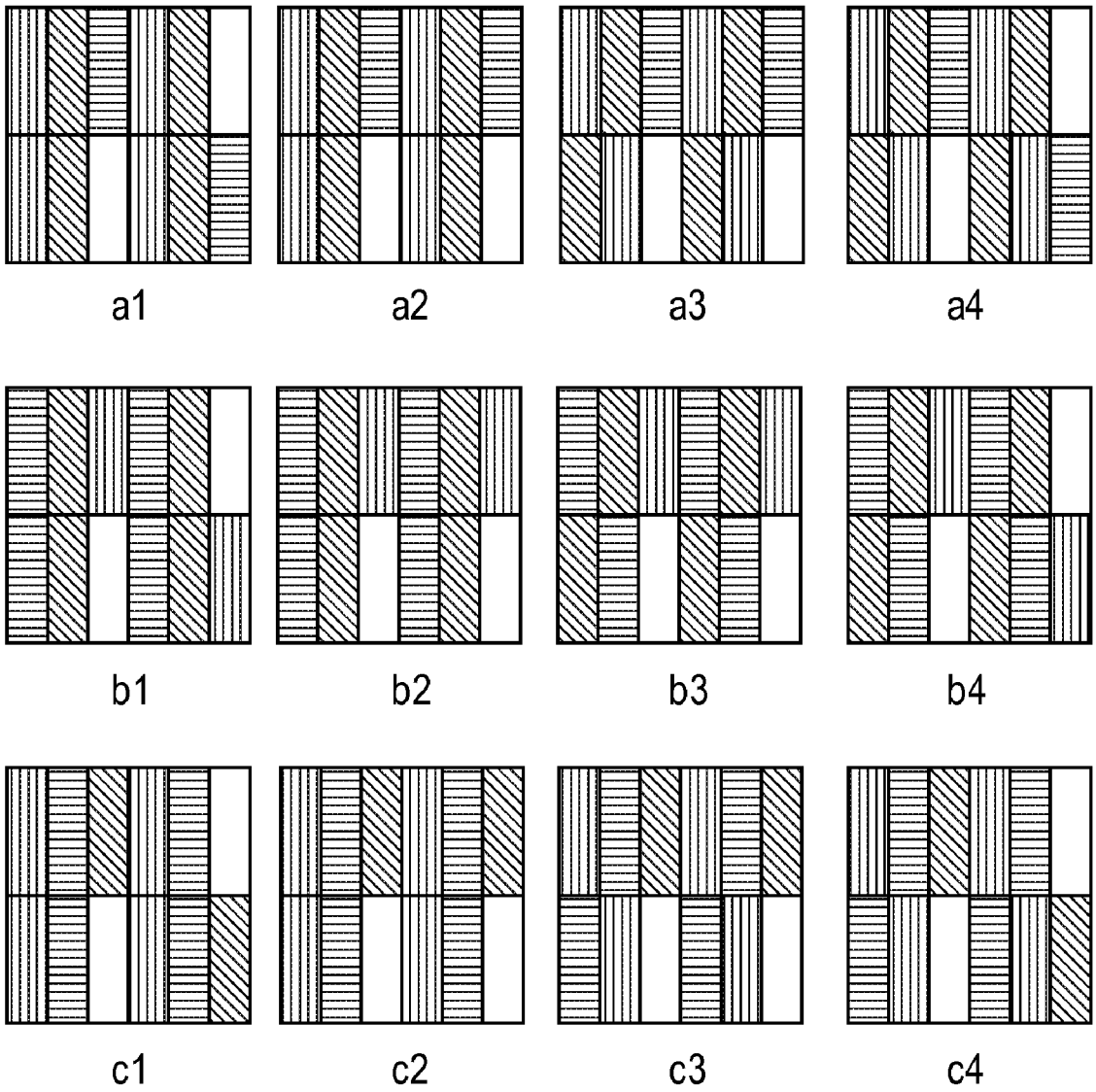

In all of the displays of FIGS. 5-7, the decrease number of blue subpixels (as compared to RGB stripe) may cause a color shift unless the transmissivity of the blue subpixel is increased or the backlight is modified to have a more bluish color point. In one embodiment, the blue filter could to be adjusted to have higher transmission (e.g. ~2×) to balance for the loss of blue. Another embodiment may utilize more saturated red and green subpixels which have less transmission and therefore may balance the blue to create a more desirable white point. A combination of fixes may also be used—i.e. change both the color filters and the backlight.

Figure 8A:
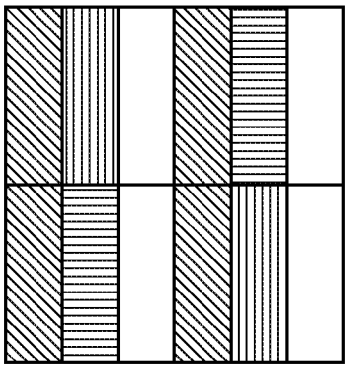
FIGS. 8A through 8C are various embodiments comprising a white stripe and a stripe of one primary color.
Figure 8B:
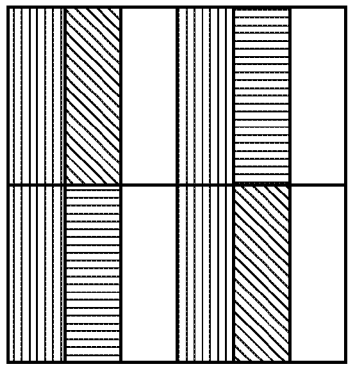
Figure 8C:
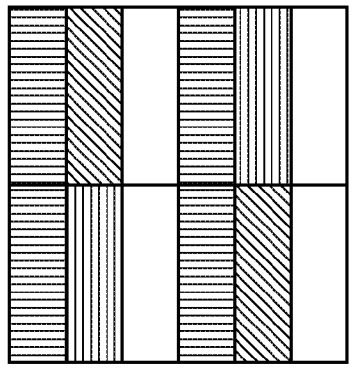

For applications where brightness is paramount and color detail is not as important, alternative subpixel repeating groups are shown in FIGS. 8A, 8B, and 8C. In these layouts, the white subpixel is striped, together with another primary color. Note that the white brightness may be high, but the pure colors may also appear darker since white is so high. These layouts may be appropriate for transflective displays where high reflectivity is desirable. Variations of symmetric and mirror image groups are also encompassed in the present application.

Figure 9:
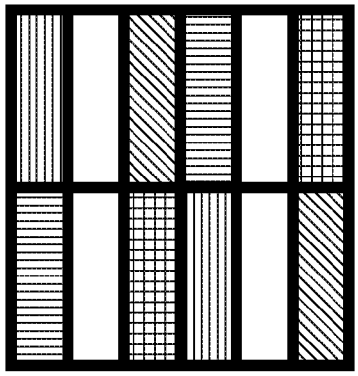
FIG. 9 is one embodiment of a subpixel layout comprising white stripes and a fourth color primary.

FIG. 9 depicts another subpixel arrangement design. In this case, the white subpixel may be striped and, instead of another primary color stripe, a substitution of another color (e.g. yellow, cyan, magenta), as shown in the square hatching, may be employed. If a bright color (e.g. yellow) is employed, then this design layout may be very bright since it has a white subpixel in every logical pixel (three subpixels per logical pixel on average). The logical pixels are very nearly balanced in luminance, the yellow being the same brightness as the red and green (R+G=Y). As is disclosed in many incorporated applications above, an optional gamut mapping algorithm (GMA) may be employed to convert input RGB image data to a RGBYW output image data. The W component may unity filtered. The R, G, and Y components may be diamond filtered. A metamer sharpening filter may be used on the Y vs. R+G subpixels, as is disclosed in co-owned WO2006127555. The B component may be diamond filtered, with or without self color sharpening or box filter without any sharpening. Of course, the present application encompasses other variations of color subpixel assignment to include, for example, symmetries and mirror-images and the like. In addition, another variation would be to have the white subpixel and the fourth colored subpixel change places. In such a case, the fourth colored primary may be the stripe and the white subpixel may be in a checkerboard with another color primary.

Figure 10:
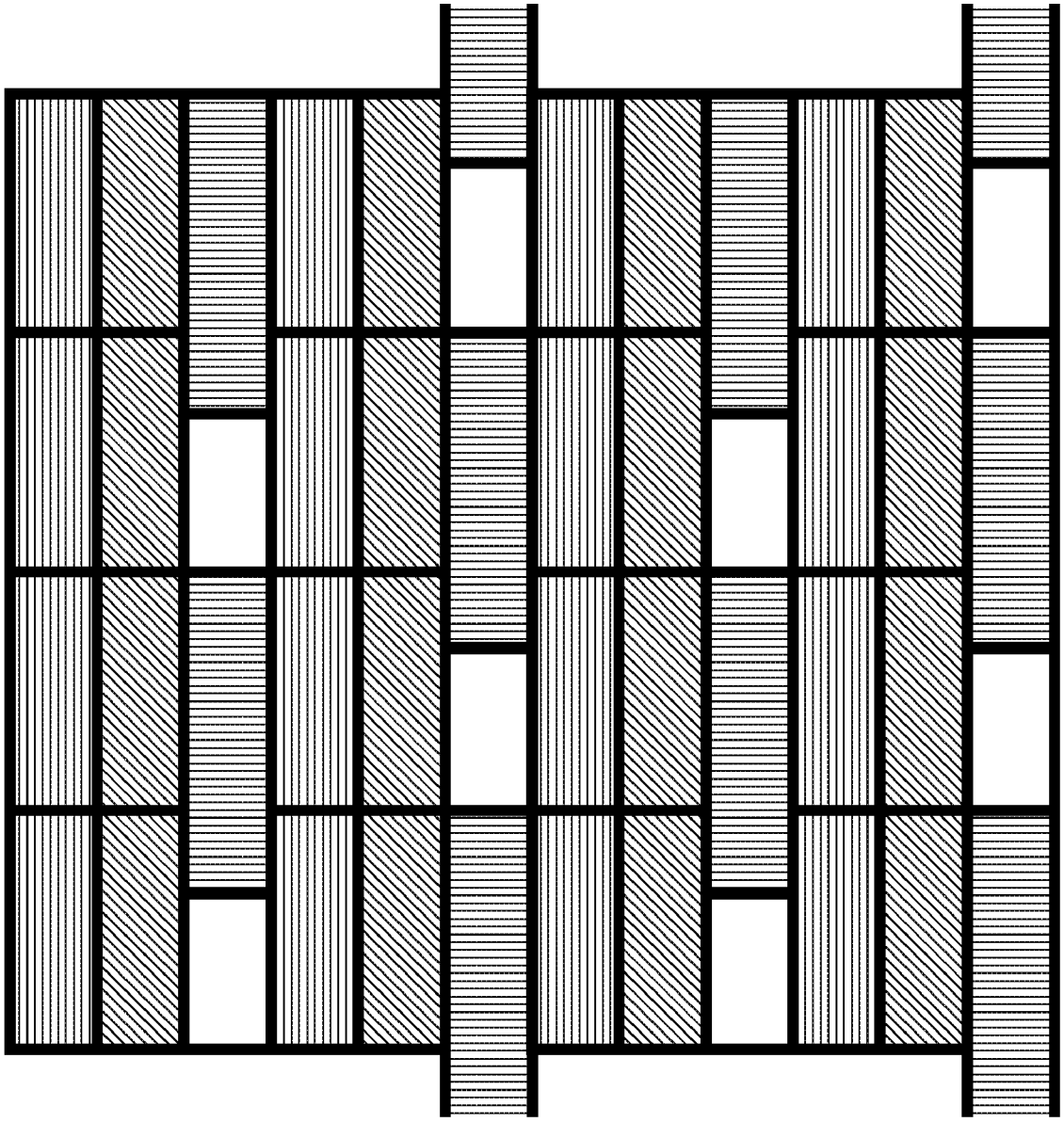
FIGS. 10, and 11A-11B are embodiments comprising a larger blue subpixel and a diminished white subpixel.
Figure 11A:
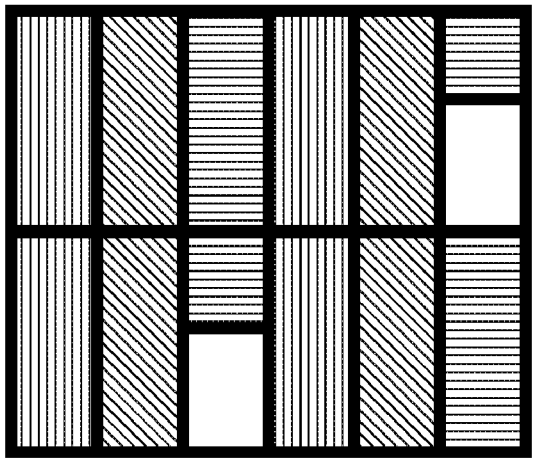
Figure 11B:
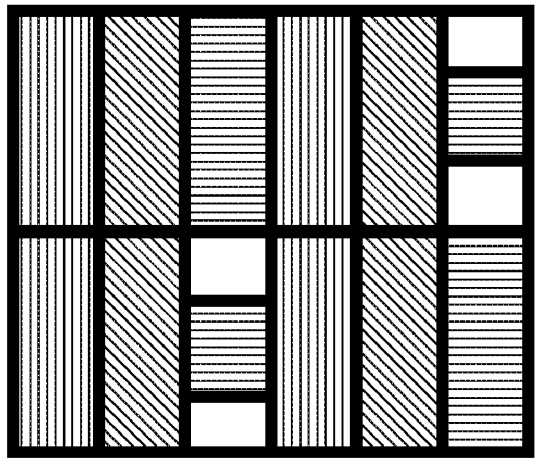

As already mentioned, it may be necessary to rebalance the color filter and backlight to achieve a desired white point. This can be done by increasing the transmission of the blue filter by making it thinner or by using different pigments/dyes. Another method to adjust the white point is to adjust the size of the blue and white subpixels, either together or separately. In FIG. 10, the blue subpixel is expanded in size at the expense of the white subpixel. The gate line may need to "zig-zag" or cross the blue subpixel in such a design. Another embodiment is shown in FIGS. 11A and 11B. The white subpixel is partially covered by the blue filter material. This drops the white transmission slightly, but also shifts the white point in the blue direction. In FIG. 11B, the blue portion of white can be placed anywhere on the white subpixel such as shown.

Figure 12A:
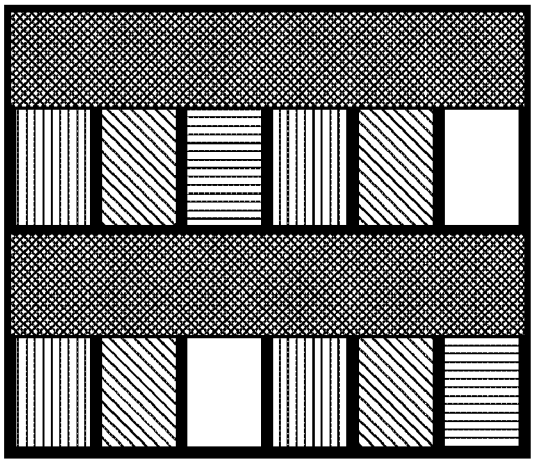
FIGS. 12A and 12B are embodiments of transflective subpixel layouts.
Figure 12B:
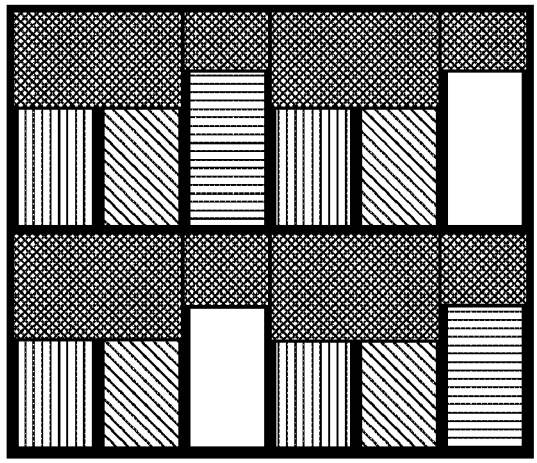

Another method to adjust the white point can be done with transflective designs. The amount of blue and white can be adjusted by setting the area for reflector and transmitter portion of each. FIG. 12A shows one embodiment of FIG. 5 having a transflective portion (noted by the cross hatched region which may also assume the color assignment of the transmissive portion. FIG. 12B shows is yet another embodiment that tends to change the white point of the display when in transmissive mode. The reflector portion for blue and white can also be adjusted differently so as to create different white point for transmission mode and reflection mode. It should be understood that various combinations of reflector sizes can be used to change both the transmissive and reflective white points.

Figure 13:
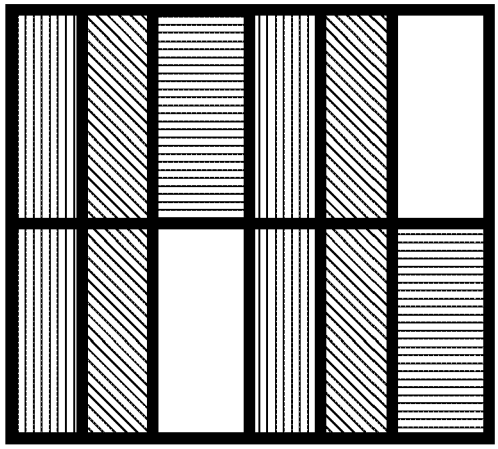
FIGS. 13, 14 and 15 are embodiments of layouts have larger blue subpixels in various configurations.
Figure 14:
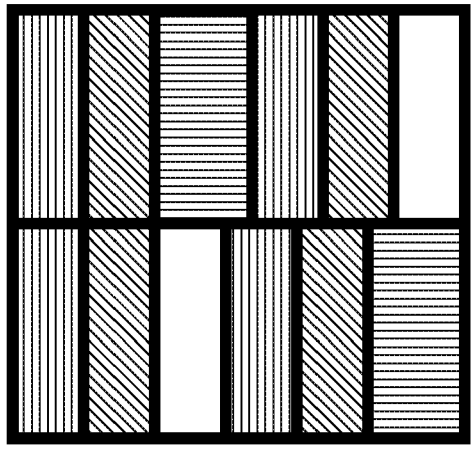
Figure 15:
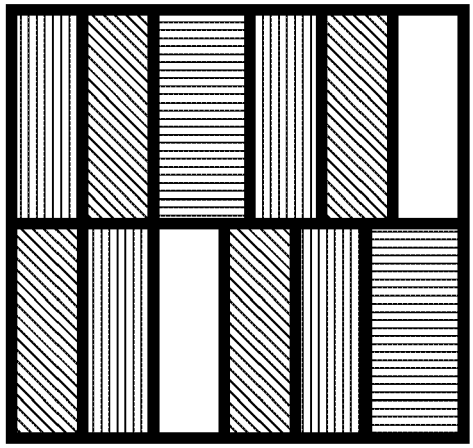

FIGS. 13, 14 and 15 depict embodiments in which the amount of blue is adjusted relative to the size of the other subpixels. FIG. 13 shows both W and B with wider subpixels. FIG. 14 shows only the blue subpixel larger that all other subpixels. In the latter case, there will be a slight zigzag appearance of RG pixels. In this case, it may be preferable to place the red and green subpixels on a checkerboard pattern so as to hide the small shift in stripe location, as is shown in FIG. 15.

It will be understood by those skilled in the art that various changes may be made to the exemplary embodiments illustrated herein, and equivalents may be substituted for elements thereof, without departing from the scope of the appended claims. Therefore, it is intended that the appended claims include all embodiments falling within their scope, and not be limited to any particular embodiment disclosed, or to any embodiment disclosed as the best mode contemplated for carrying out this invention. In addition, the above embodiments apply in all manner of display manufacture, including LCD, OLED, electropheretic and the like.

What is claimed is:

1. A display device comprising:

a display panel substantially comprising a plurality of subpixel repeating groups; each said subpixel repeating group comprising subpixels of a first primary color, a second primary color, a third primary color and a fourth color arranged in first and second rows;

an input image data unit configured to receive input image data; and a subpixel rendering unit configured to subpixel render said input image data for rendering on said display panel; said subpixel rendering unit performing area resampling of said input image data to produce luminance values for each of the subpixels of the display panel; and wherein said subpixel repeating group comprises, in order, a first column stripe of said first primary color subpixels, a second column stripe of said second primary color subpixels, a third column having a first alternating pattern of said third primary color subpixels and said fourth color subpixels, a fourth column that is substantially the same as the first column stripe, a fifth column that is substantially the same as the second column stripe, and a sixth column having a second alternating pattern of said third primary color subpixels and said fourth color subpixels.

2. The display device of claim 1 wherein said fourth color is substantially white.

3. The display device of claim 2 wherein one of said primary colors is substantially blue.

4. The display device of claim 3 wherein the size of said blue subpixel is larger than the size of said white subpixel.

5. A display device comprising:

a display panel substantially comprising a plurality of a subpixel repeating group; said subpixel repeating group comprising subpixels of a first primary color, a second primary color, a third primary color and a fourth color arranged in first and second rows;

an input image data unit configured to receive input image data; and a subpixel rendering unit configured to subpixel render said input image data for rendering on said display panel; said subpixel rendering unit performing area resampling of said input image data to produce luminance values for each of the subpixels of the display panel;

wherein said subpixel repeating group comprises two adjacent column stripes of said first and said second primary colors and an alternating column pattern of said third primary color and said fourth color;

wherein said fourth color is substantially white;

wherein one of said primary colors is substantially blue; and wherein the size of said blue subpixel is larger than the size of said white subpixel; and wherein said display further comprises a transreflective area for said subpixels and the transmissive portion for said blue subpixel and said white subpixel is larger than other primary colors.

6. A display device comprising:

a display panel substantially comprising a plurality of a subpixel repeating group; said subpixel repeating group comprising subpixels of a first primary color, a second primary color, a third primary color and a fourth color arranged in first and second rows;

an input image data unit configured to receive input image data; and a subpixel rendering unit configured to subpixel render said input image data for rendering on said display panel; said subpixel rendering unit performing area resampling of said input image data to produce luminance values for each of the subpixels of the display panel;

wherein said subpixel repeating group comprises two adjacent column stripes of said first and said second primary colors and an alternating column pattern of said third primary color and said fourth color;

wherein said subpixels of said subpixel repeating group are arranged in one of a group of subpixel layout patterns; the group of subpixel layout patterns comprising

| | | | | | |
|---|---|---|---|---|---|
| R | G | B | R | G | W |
| R | G | W | R | G | B |
| and | | | | | |
| R | G | B | R | G | B |
| R | G | W | R | G | W; |
| and | | | | | |
| B | G | R | B | G | W |
| B | G | W | B | G | R; |
| and | | | | | |
| B | G | R | R | G | R |
| B | G | W | R | G | W; |
| and | | | | | |
| R | B | G | R | B | W |
| R | B | W | R | B | G; |
| and | | | | | |
| R | B | G | R | B | G |
| R | B | W | R | B | W |

wherein W is substantially white, G is substantially green, R is substantially red, and B is substantially blue.

7. A display device comprising:

a display panel substantially comprising a plurality of a subpixel repeating group; said subpixel repeating group comprising subpixels of a first primary color, a second primary color, a third primary color and a fourth color arranged in first and second rows;

an input image data unit configured to receive input image data; and a subpixel rendering unit configured to subpixel render said input image data for rendering on said display panel; said subpixel rendering unit performing area resampling of said input image data to produce luminance values for each of the subpixels of the display panel; and wherein said subpixel repeating group comprises two rows and six columns of subpixels, wherein:

the first two of said six columns comprise two adjacent columns of subpixels that are a first column having a first alternating pattern of the first and second primary color subpixels, and a second column having a second alternating pattern of the first and second primary color subpixels, the first alternating pattern being different from the second alternating pattern, the third column is adjacent to the second column, and comprises an alternating pattern of said third primary color subpixels and said fourth color subpixels, the fourth and fifth columns are adjacent to each other and the fourth column is adjacent to the third column, the fourth column having the first alternating pattern and the fifth column having the second alternating pattern, and the sixth column is adjacent to the fifth column and comprises an alternating column pattern of said third primary color subpixels and said fourth color subpixels.

8. The display device of claim 7 wherein said fourth color is substantially white.

9. The display device of claim 8 wherein one of said primary colors is substantially blue.

10. The display device of claim 9 wherein the size of said blue subpixel is larger than the size of said white subpixel.

11. A display device comprising:

a display panel substantially comprising a plurality of a subpixel repeating group; said subpixel repeating group comprising subpixels of a first primary color, a second primary color, a third primary color and a fourth color arranged in first and second rows;

an input image data unit configured to receive input image data; and a subpixel rendering unit configured to subpixel render said input image data for rendering on said display panel; said subpixel rendering unit performing area resampling of said input image data to produce luminance values for each of the subpixels of the display panel;

wherein said subpixel repeating group comprises two rows and six columns of subpixels, wherein the first two of said six columns comprises two adjacent columns of subpixels comprises a pattern of alternating first and said second primary colors in a checkerboard pattern, the third column comprises an alternating pattern of said third primary color and said fourth color, the fourth and fifth columns comprise a pattern of alternating first and said second primary colors in a checkerboard pattern, and the sixth column comprises an alternating column pattern of said third primary color and said fourth color;

wherein said fourth color is substantially white;

wherein one of said primary colors is substantially blue;

wherein the size of said blue subpixel is larger than the size of said white subpixel; and wherein said display further comprises a transreflective area for said subpixels and the transmissive portion for said blue subpixel and said white subpixel is larger than other primary colors.

12. The display device of claim 7 wherein said subpixels of said subpixel repeating group are arranged in one of a group of subpixel layout patterns; the group of subpixel layout patterns comprising

| | | | | | |
|---|---|---|---|---|---|
| R | G | B | R | G | W |
| G | R | W | G | R | B |
| and | | | | | |
| R | G | B | R | G | B |
| G | R | W | G | R | W; |
| and | | | | | |
| B | G | R | B | G | W |
| G | B | W | G | B | R; |
| and | | | | | |
| B | G | W | B | G | W |
| G | B | R | G | B | R; |

-continued

| | | | | | |
|---|---|---|---|---|---|
| and | | | | | |
| R | B | G | R | B | W |
| B | R | W | B | R | G; |
| and | | | | | |
| R | B | W | R | B | W |
| B | R | G | B | R | G |

wherein W is substantially white, G is substantially green, R is substantially red, and B is substantially blue.

13. A display device comprising a display, said display comprising subpixels wherein said subpixels further comprise substantially a subpixel repeating group arranged as;

| | | | | | |
|---|---|---|---|---|---|
| R | W | G | B | W | Y |
| B | W | Y | R | W | G |

wherein W is substantially white, Y is substantially yellow, G is substantially green, R is substantially red, and B is substantially blue.

* * * * *